US007555795B1

(12) United States Patent
Feil

(10) Patent No.: US 7,555,795 B1
(45) Date of Patent: Jul. 7, 2009

(54) TOE REST IN BED AND BLANKET SUPPORT

(75) Inventor: Kim Triolo Feil, 409 N. Elm St., Arlington, TX (US) 76011

(73) Assignee: Kim Triolo Feil, Arlington, TX (US)

( * ) Notice: Subject to any disclaimer, the term of this patent is extended or adjusted under 35 U.S.C. 154(b) by 0 days.

(21) Appl. No.: 11/900,584

(22) Filed: Sep. 13, 2007

Related U.S. Application Data

(60) Provisional application No. 60/849,574, filed on Oct. 5, 2006.

(51) Int. Cl.
*A47C 20/00* (2006.01)
*A47C 21/02* (2006.01)

(52) U.S. Cl. ..... 5/651; 5/648; 5/505.1; 5/692

(58) Field of Classification Search ..... 5/651, 5/648, 624, 503.1, 504.1, 505.1, 690–692, 5/731, 734, 506.1, 655.9, 740, 953; D6/601
See application file for complete search history.

(56) References Cited

U.S. PATENT DOCUMENTS 988,117 A * 3/1911 Leonard ..... 5/722
1,067,733 A * 7/1913 Hassel ..... 5/651
1,418,501 A * 6/1922 Weinshenk ..... 5/417
1,547,879 A * 7/1925 Lambert ..... 5/651
1,972,673 A * 9/1934 Baird ..... 5/692
2,160,443 A * 5/1939 Schadell ..... 126/205
2,880,428 A * 4/1959 Forsland ..... 5/636
3,639,927 A * 2/1972 Munch ..... 5/723
3,742,528 A * 7/1973 Munch ..... 5/723
3,803,645 A * 4/1974 Oliverius ..... 5/650
D255,854 S * 7/1980 Gay ..... D6/601
5,101,526 A * 4/1992 Smith ..... 5/630
5,109,872 A * 5/1992 Conn ..... 5/652
5,134,739 A * 8/1992 Gaffe et al. ..... 5/648
5,172,439 A * 12/1992 Farley ..... 5/722
5,175,899 A * 1/1993 Lou ..... 5/505.1
5,430,901 A * 7/1995 Farley ..... 5/730
5,530,974 A * 7/1996 Rains et al. ..... 5/81.1 T
5,603,336 A * 2/1997 Shepich ..... 128/882
5,740,571 A * 4/1998 Tyra ..... 5/624
5,745,939 A * 5/1998 Flick et al. ..... 5/648
5,978,991 A * 11/1999 Miles ..... 5/651
2006/0016012 A1 * 1/2006 Liu ..... 5/651

* cited by examiner

*Primary Examiner*—Robert G Santos

(57) ABSTRACT

What is claimed is a toe-rest bed bolster that simultaneously serves as a blanket-support. In the supine position, toes gently rest on the curved edge. Comfort is achieved in supporting behind the toes to prevent gravity's downward pull while relieving the weight of heavy blankets and tangled sheets. Embodiments broadly cover toe resting on a rounded edge in three methods: removable, installed or permanently built into mattress. Side sleepers also benefit from toe tent/toe rest provided by curved edge. Invention also has a dual pillow configuration method of use to accommodate taller people. Blanket support frames are improved by attaching toe rest cushion. Prior art of manufactured, trapezoidal shaped mattress protrusion is also improved by inventor's built in curved protrusion for the novel concept of toe-resting.

1 Claim, 13 Drawing Sheets

TOE REST IN BED AND BLANKET SUPPORT

CROSS-REFERENCE TO RELATED APPLICATION

This application claims priority to the U.S. Provisional application Ser. No. 60/849,574 and is entitled to the filing date of Oct. 5, 2006 named as Toe-Rest in Bed and Blanket Lift. Contents of prior application is incorporated by reference in view of this.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not applicable

BACKGROUND OF THE INVENTION

Field of endeavor relates to cylindrical or semi-cylindrical shapes of foam cushions for toe-rest/blanket lift to be removable, or installed, or permanent to the bed. No prior art has been found for partially round shaped protrusions and or method of cushion arrangement specifically for the toes to rest upon in bed.

Novel is claimed in the concept for a toe-rest as inventor differentiates this from the prior art of foot rests and foot stops in bed which focused claims on medical applications such as foot drop, patient exercise or for patient repositioning by pushing against the apparatus to assist patients sliding down in the bed (U.S. Pat. No. 3,866,251, February 1975, Pounds). Prior art for foot rest also claimed for warming the feet (U.S. Pat. No. 1,067,733, July 1913, Hassel), or vibrating the feet in bed (U.S. Pat. No. 6,668,401, December 2003, Waters). Whereas inventor's removable bolsters focus on a simple, yet effective, affordable, comfort pillow to gently rest the toes against to support the toes from gravity's downward pull and is not intended for pushing feet against.

Inventor's installed version of a bolster that is partially round and sloping to meet base that attaches to blanket lift frame reduces space at the foot of the bed for taller people to be able to toe-rest and improves prior art in ease of use, installation, and affordability of cushioned foot supports (U.S. Pat. No. 3,284,817, November 1966, Landwirth, U.S. Pat. No. 3,866,251, February 1975, Pounds, U.S. Pat. No. 5,175,899, January 1993, Lou) when used as a toe support for comfort.

Prior art found for foot rests, foot stops, blanket-lift frames or blanket lift foam wedge, exercise kick bags, and round shaped pillows is riddled with incompatibilities in either, size, shape, resiliency, pillow use methods, and pillowcase fabrics to serve as a toe-rest which simultaneously is also a blanket support. Related prior art is problematic in not accommodating a range of body sizes, and not being user friendly or affordable.

In general, prior art for foot-rest devices needing installation, or containing attachments, make them harder and more expensive to mass produce, and not user friendly. Other problems with prior art relate to materials used as being cold or hard to the human touch. Still, other incompatibilities found with prior art containing suitable foam (reference foam, wedge shape blanket lift U.S. Pat. No. 6,668,401, December 2003, Waters) did not have the round design whose function is to reach out to the toes to be rested against. Also prior art foam, wedge, blanket lift also has problems accommodating medium to tall people in bed in requiring feet to be placed in front of the cushion.

Inventor's dual pillow configuration accommodates medium to tall people in bed with a toe-tent and baby toe rest when the feet are placed between two said cushions in the supine position with the option to baby toe rest which is desirable to support the toes in the upright position (U.S. Pat. No. 2,095,459, October 1937, Tottenham).

Prior art found for cylindrical, multiple, foam pillows lack the dual pillow configuration and sizing specifications of invention needed to function as toe-rest/blanket support (U.S. Pat. No. 4,528,981, July 1985, Behar & U.S. Pat. No. 5,572,757, December 1996, O'Sullivan).

To accommodate medium to tall people in bed with a frontal toe-rest blanket lift where the feet are placed in front of a single cushion, prior art found for half-round bolsters as free standing cushions lack stability in keeping the curved edge facing the toes. Invention for an installed version of a toe-rest/blanket lift improves on prior art blanket lift frames (U.S. Pat. No. 6,834,403, December 2004, Elliott), by adding a partially round cushion whose pillowcase has the means to be fastened to the stabilizing frame. Also, inventor has unique shaped, partially round bolster and sloping to meet with a flat base that is designed to be used with a more affordable blanket lift frame that is not adjustable in height where the flat edge rests on the bed while being stabilized by the blanket lift frame.

Inventor recognized the need for a permanent, partially round and sloping to meet base protrusion to be manufactured into longer beds to accommodate taller people to place their feet in front of the cushion to toe-rest while utilizing the blanket lift. Therefore, this invention is broad in covering specialty mattresses and box springs to be manufactured in longer lengths. This improves prior art for the combination foot rest and blanket lift that is built into the mattress (U.S. Pat. No. 1,972,673, September 1934, Baird) whose trapezoidal shape protrusion does not promote toe resting. Patent search information of related prior art is as follows . . . .

U.S. Pat. No. 1,210,019, December 1916, Truman

Round pillow built into mattress; designed for head. Not for toe resting.

U.S. Pat. No. 243,868, July 1881, Doremus

Drawing shows fabric rolled and sewn together into longer than round shape. No suggested diameter or length sizing or body part usage indicated. Not resilient, has no pillowcase for easy washing, and is not easily manufactured.

U.S. Pat. No. 1,067,733, July 1913, Hassel

Curved shape foot warmer in bed w/attachments to bed frame. Covering for padding is to be wool like, warm fabric. Stated foot rest/foot stop option in the dotted line of drawing in the down position is then not tall enough to be a simultaneous blanket lift.

U.S. Pat. No. 1,211,257, January 1917, Thomas

Cylindrical pillow with coils & springs with a hollow center and can be fitted with lace to be used as a decorative sham. Has no suggested diameter/length sizing, or body part usage indicated. Not easily manufactured.

U.S. Pat. No. 1,547,879, July 1925, Lambert

Combination foot rest/blanket lift in bed. Made of wood slats and is wedge shaped. Not curved to reach out to the toes.

U.S. Pat. No. 1,972,673, September 1934, Baird

Combination trapezoidal shaped foot rest and blanket lift manufactured into mattress. Not curved to function as a toe rest.

U.S. Pat. No. 2,095,459, October 1937, Tottenham

Wooden footboard attached to bed rail, is a foot protector and foot rest to keep toes pointing in the upward position that requires installation. Material is not of comfort to the touch. Not flexible to various sleep positions.

U.S. Pat. No. 2,160,443, May 1939, Schadell

Wedge shaped blanket lift, made of wood with light bulb inside of case for warmth-no claim to foot-rest in bed. Not easily manufactured. Material is not of comfort to the touch.

U.S. Pat. No. 2,229,536, January 1941, Wilkich

Concave shape built into mattress. Not shaped for toe resting.

U.S. Pat. No. 3,195,151, July 1965, Boyer and U.S. Pat. No. 6,496,993, December 2002, Allen Sliding footboard is to increase bed length that requires an expensive, custom frame. Has no curved shape bolster for toe resting.

U.S. Pat. No. 3,234,569, February 1966, Stewart

Neck, and back bolster, made of fiber filling with ties. Not made of supportive material.

U.S. Pat. No. 3,284,817, November 1966, Landwirth

Foam wedge with attached bolster roll for footrest of bedridden patient to be used in the sitting up in bed position. Not easily used or manufactured. Not for the supine position.

U.S. Pat. No. 3,378,861, April 1968, Lousberg

Upper body elevating mattress with built in foot rest. Not round to serve as toe rest.

U.S. Pat. No. 3,719,185, November 1970, Hanes

Neck bolster formed by rolling fabric or foam and has semi rigid tubular core. Harder to manufacture.

U.S. Pat. No. 3,803,645, April 1975, Oliverius

Inflatable blanket lift for hosp bed & foot support for drop foot with fasteners. Not easy to use and tend to loose air.

U.S. Pat. No. 3,866,251, February 1975, Pounds

Half round, foam, foot rest with board attached to hospital frame for patient prevention of sliding down the bed by pushing against. Not easy to install and expensive to manufacture.

U.S. Pat. No. 3,992,733, November 1976, Racine

Pouffe pillow constructed from square or rectangular shaped foam that is covered with elastic fabric pillow case that contorts foam into rounded shaped edges using the tension created by the drawstring closures on opposing ends. Not easily mass manufactured, no uses or sizes indicated. Fabric is not suitable for pillowcase for human touch.

U.S. Pat. No. 4,214,327, July 1980, Smith

Ninety degree angle support board blanket lift. Has no means to attach bolster for toe rest.

U.S. Pat. No. 4,286,344, September 1981, Ikeda and U.S. Pat. No. 6,249,924, June 2001, Kluft Built in protrusions on the sides of the mattress to keep patients from rolling out of bed. Pillow configuration and diameters not suited for toe-rest/blanket lift.

U.S. Pat. No. 4,528,981, July 1985, Behar

Dual bolster head restraint for a stretcher with adjustable straps. Not easily manufactured.

U.S. Pat. No. 4,607,402, August 1986, Pollard and U.S. Pat. No. 4,872,228, October 1989, Bishop Bed side rail cushion cylindrical guards added to bed to prevent person from falling out of bed. Pillow configuration and diameters not suited for toe-rest/blanket lift.

U.S. Pat. No. 5,175,899, January 1993, Lou

Mattress with means for installation of blanket support, with pivot functions and has optional heating device. Custom mattress needed to attach bolster frame. Not easily manufactured or affordably priced. Not easy to install.

U.S. Pat. No. 5,572,757, December 1996, O'Sullivan

Double and triple half round cushions joined by zipper for head, neck and back support, not for blanket lift or toe-rest use. Pillow configuration not suited for toe-rest/blanket lift.

U.S. Pat. No. 5,740,571, April 1998, Tyra

Pivoting, cylindrical shaped padding attached to bed for invalid exercise and repositioning in bed that requires installation and is more expensive to manufacture.

U.S. Pat. No. 5,745,939, May 1998, Flick et al.

Three piece foam set to keep patient's feet in supine position. Pillow configuration is not suitable for toe-rest/blanket lift and does not allow for side sleeping flexibility.

U.S. Pat. No. 6,067,679, May 2000, Rice

Pillow rolled into cylindrical shaped bolster with flap for patient propping on their side. Flap is not useful in application as toe-rest/blanket lift and makes it harder to manufacture. Has no pillow configuration for dual use toe-rest/blanket lift that accommodates tall people.

U.S. Pat. No. 6,464,622B2, June 2002, Nichols, Jr.

Round, boxing bag on a base with vinyl covering is more expensive and not suitable for bed use.

U.S. Pat. No. 6,668,401, December 2003, Waters

Triangular wedge, U, or L shaped foam blanket lift with options for pockets for herbal scents and foot vibrator. Not ideal as a toe rest because edges facing the toes are flat and need to be round to reach out to the toes. Has no pillow configuration for dual use toe-rest/blanket lift that accommodates tall people.

U.S. Pat. No. 6,708,353 B2, March 2004, Han

Spine aligner columnar shaped. Not ideal as toe-rest because edges are not round.

U.S. Pat. No. 6,795,990 B1, September 2004, Hutchinson

Set of cylindrical shaped pillows t shaped with straps for arm and back support. Not easily manufactured. Has no pillow configuration for dual use toe-rest/blanket lift that accommodates tall people.

U.S. Pat. No. 6,782,572, August 2004, Jones

Disposable travel pillow for neck, head and back that is hollow and cylindrical composed of stuffing with fasteners. Fabric not resilient enough for blanket lift. Not easily manufactured.

U.S. Pat. No. 6,834,403, December 2004, Elliott

Frame blanket lift has handles on bed and overhead bars. Obstructs bed space. Has no comfort cushion to rest toes on.

U.S. Pat. No. 6,990,699 B2, January 2006, Hedges

Pneumatic free air chamber hollowed, foam bolster for various body parts to rest against-foam plugs allow for different grades of foam to be plugged into part of the hollow space air chamber. Not easily manufactured.

U.S. Pat. No. 7,188,382, March 2007, Taylor, et al.

Ankle or arm elevator with fasteners that wrap around. Slit and hollowed groove in foam reduces it's resiliency to be supportive as blanket lift. Has no pillow configuration for dual use toe-rest/blanket lift that accommodates tall people.

U.S. Pat. No. 7,207,930, April 2007, Bonutti

Exercise balls in a two set configuration, not suited for bed use.

BRIEF SUMMARY OF THE INVENTION

The object of the bed pillow invention is a toe-rest that is either free standing, installed, or permanently built into the mattress while allowing enough space at the foot of the bed.

The toe-rest is a cushion to pamper healthy feet in bed. It is simultaneously a blanket lift which makes it even more useful for medical applications while also relieving tangled and distracting sheets. In the supine position, by gently resting the toes on a curved cushion, comfort is achieved by preventing gravity from pulling the toes into a pointed down position. In the side sleeping position, comfort is achieved by the tent space created while providing a comfortable toe-rest.

The simplicity of the removable cushion(s) allows for ease of use, affordability, and flexibility in a variety of sleep positions. The dual pillow configuration accommodates taller people when feet are placed between two cushions instead of placing feet in front of one cushion which is an improvement to prior art of the foam, wedge cushion that is problematic to tall people by requiring the feet to be placed in front of the wedge shape which is takes up too much space, and is not round to serve as a baby toe-rest which is desirable to support the toes in the upright position while in the supine position in bed.

In the installed toe-rest/blanket lift, inventor improved prior art blanket lift frames by adding a partially round and sloping to meet flat base bolster for the toe-rest/blanket lift concept while accommodating different heights of people by partially reducing the diameter of the cushion and saving space at the foot of the bed.

In the permanent toe-rest/blanket lift, a generally round protrusion is built-in or added to the mattress during manufacture and a longer length bed accommodates taller people to enjoy the frontal toe rest while in the supine position.

DETAILED DESCRIPTION OF THE INVENTION

In relieving discomfort caused by the weight of blankets pushing on the front and tip of the toes, it can be rationalized that doing the opposite (providing support behind the toes) can increase comfort.

The prototype started from a child's karate kick bag which was 7" in diameter. In placing the round cushion between the flat and fitted sheets at the foot of the bed as a blanket lift, inventor relieved the weight of the heavy blankets off of her inflamed bunion. The novel toe-rest concept was conceived when the inventor found additional comfort by gently resting her toes on the rounded portion of the bolster which prevents gravity from pulling down on the toes. When the bunion improved, inventor came to depend on the toe-rest as a pampering, podiatry pillow to the extent of needing one when traveling, especially when at a hotel or motel where they have a reputation for extremely tightly tucked sheets.

Toe resting also has medical benefits in aligning the spine when in the supine position. Because a toe-rest simultaneously is a blanket lift, pillow is useful for medical podiatry applications. Hospitals and same day surgery centers generally do not discharge a patient with a blanket lift to take home. Since the invention is an improvement to blanket lifts, information on the medical benefits will be limited here, with full details given to improvements to prior art and the toe-rest/blanket lift concept. However, inventor would like to point out that portable, foam, blanket lifts should not be limited to just the feet. Any body part such as an arm, elbow, wrist, hand, knee, and ankle can be protected from blankets or sheets for post orthopedic surgical recovery, general wound care, or sports injuries.

FIGS. 1 through 9 will describe in detail the making and use of inventor's removable bolster(s). Remaining FIGS. 10 through 13 will describe in detail the installed and the permanent embodiments.

Figure 1:
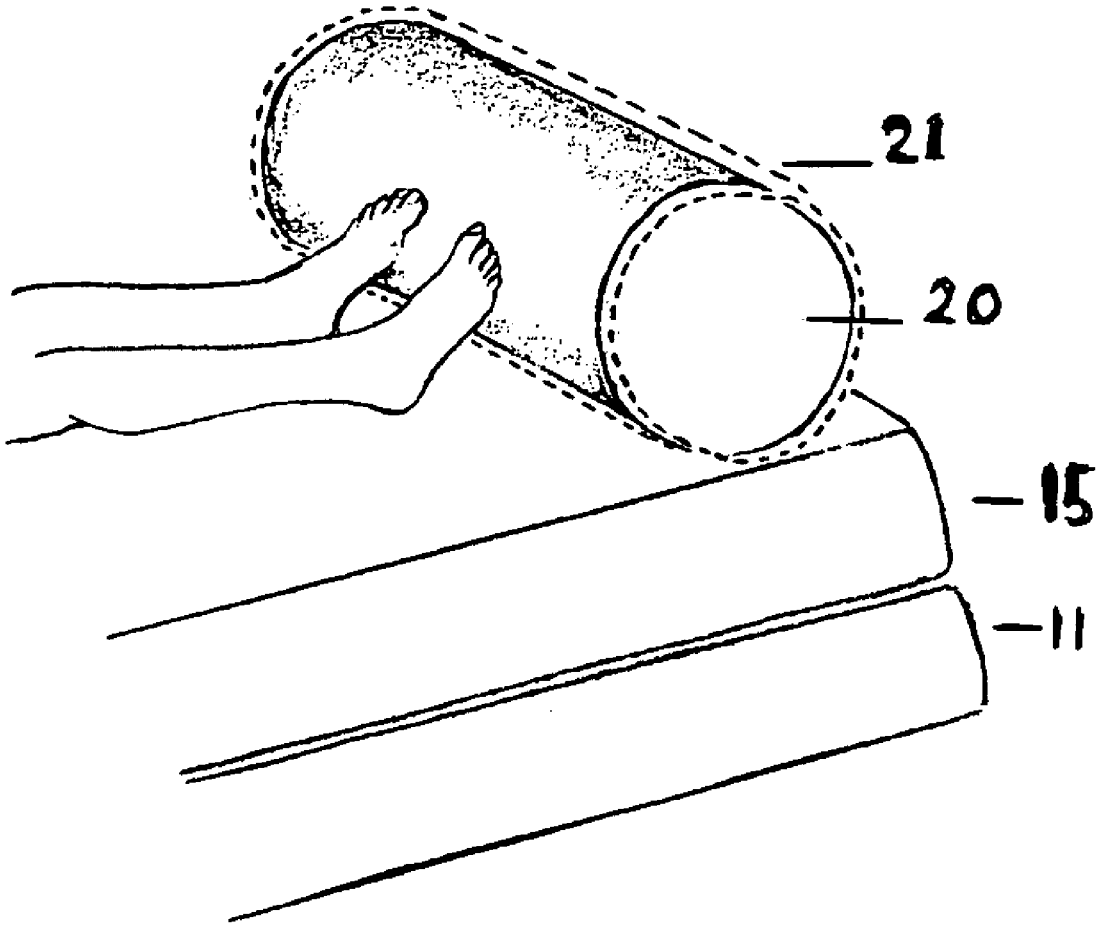
FIG. 1. is right side view of long bolster in long pillowcase.

As seen in FIG. 1. is a right side view of a long bolster 20 in a pillowcase 21. The bolster is placed between the flat and fitted sheets with the feet facing the front of the cushion and the toes gently resting on the curved edge while in the supine position on a bed (box frame 11, mattress 15). Side sleepers can also toe-rest by positioning the bolster at a right or left angle.

The tension from the tucked in flat sheet and the weight of any additional blankets keep the cushion in place. However, for supine loungers/sleepers, there are limitations to persons of height that do not have additional space at the foot of the bed. For example, the inventor uses a 9 inch diameter bolster, and users need to have an additional 8 or 9 inches to spare at the foot of the bed.

The foam should be soft-yet firm, and an ILD rating of 30 which means it takes 30 pounds of pressure to depress one inch. Inventor uses the medium-soft density polyurethane foam which is more economical than the higher density foams that require more petroleum products. Memory foam in varying ILD ranges that render the cushion to be soft, yet resilient can be used.

The frontal toe-rest/blanket lift is a generally round, cylindrically shaped single bolster 20 with two flat opposing ends with diameters of at least 8 inches and larger, and whose length is generally twice its diameter which inventor uses an 18" length.

The pillowcase 21 can be closed with a zipper, Velcro, tuck flap or any other means that is normal for pillowcase covering and is not distracting to the human touch. The fabric inventor uses is 100% cotton in a bleached white color of at least a 200 thread count. More economical blends such as cotton/polyester, or other non-decorative comfort to the touch, fabrics suitable for pillowcase bed clothes can be used. In institutional use, fabric requirements such as anti-microbial or fire retardant guidelines should be followed.

Figure 2:
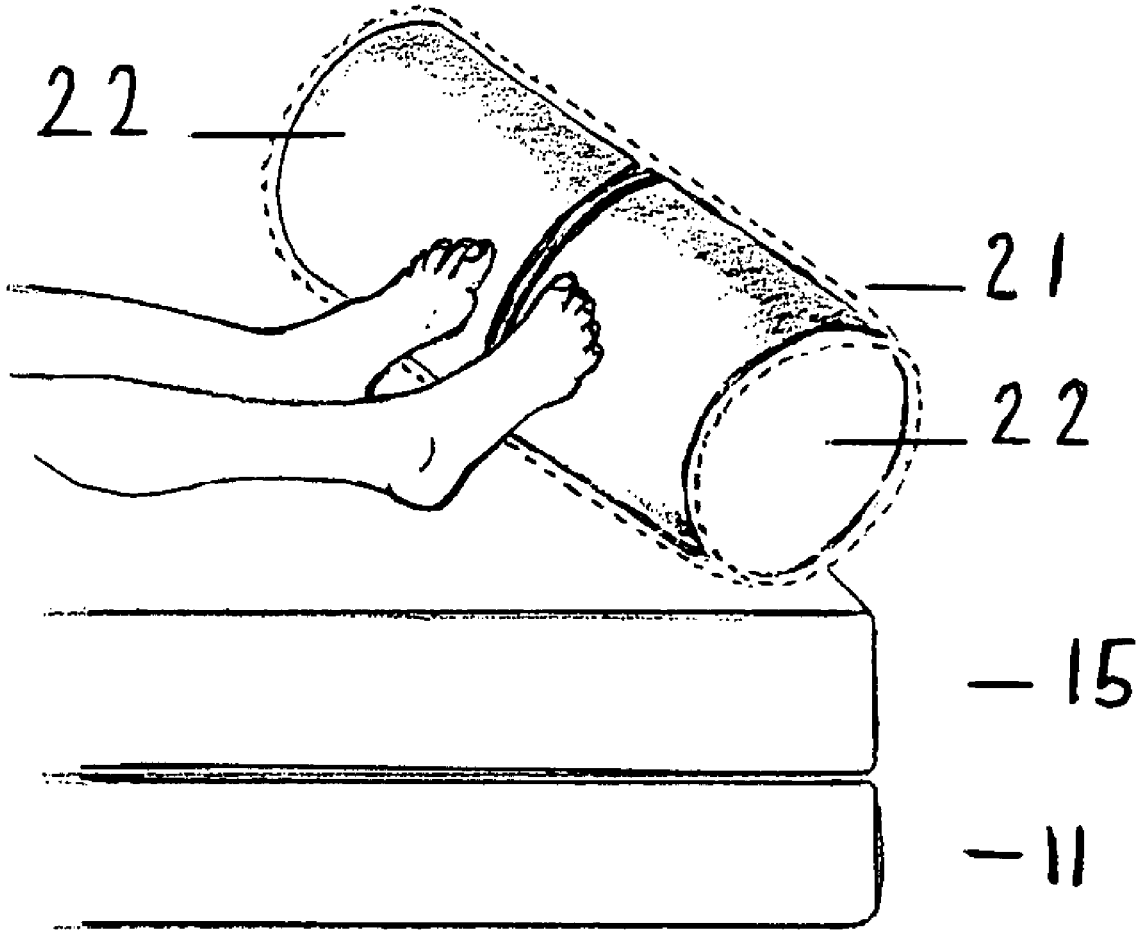
FIG. 2. is right side view of two short bolsters in a long pillowcase.

As shown in FIG. 2 is a right side view of two short bolsters 22 in a long pillowcase 21 with toes resting on the curved edge while in the supine position on a bed. In the supine position, the long bolster is formed when combining two of the short (9" diam.by 9" length) cushion's 22 flat edges together in the long (9" diam by 18" length), pillow case 21. The, long bolster is for the frontal toe-rest and functions as described in FIG. 1.

The dual pillow system is novel and superior to prior art of foam wedges and long, round bolsters in three aspects. The first improvement to the wedge is that the cylindrical shape reaches out to the toes to be rested against. The second aspect is that two short, bolsters (described as a ball with two opposing flat ends) reduce transportation costs in shipping smaller parcels, and the third aspect is the flexibility of placing feet in front of, or between two cushions.

Figure 3:
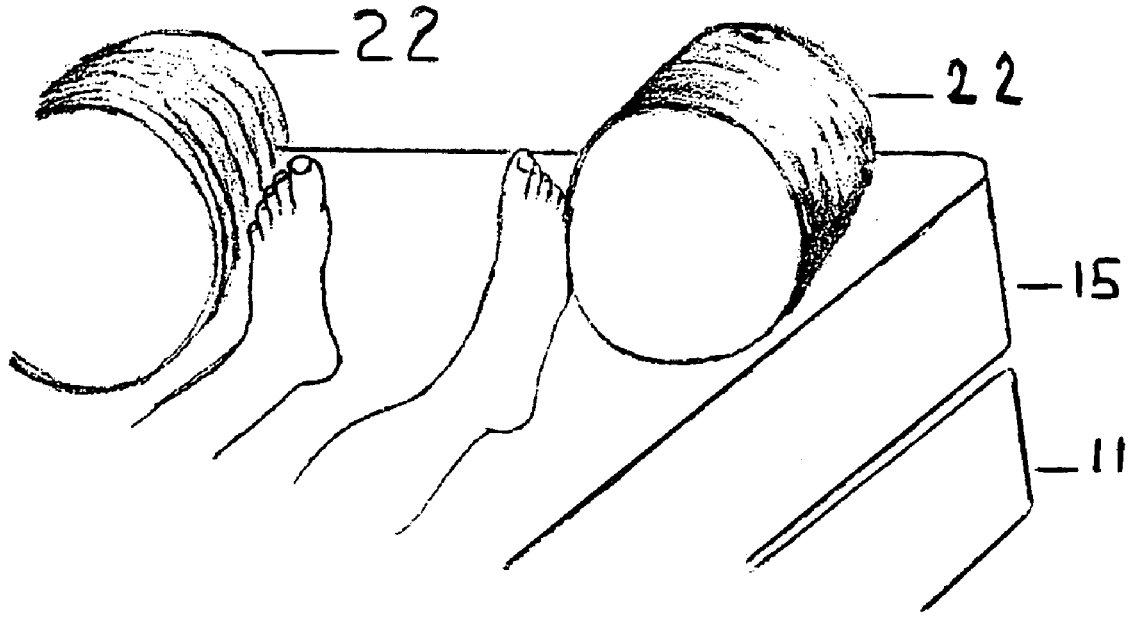
FIG. 3. is right, aerial view of two short bolsters.

FIG. 3 shows the dual pillow system for taller people for the toe-tent/toe-rest. FIG. 3. is a right, aerial view of two short bolsters 22 with baby toes resting on the curved edges while in the supine position. Small to medium sized feet are placed between the cushions on a bed 11,15. The dual pillow system is two generally round bolsters with two flat opposing ends whose diameter is equal to its length which inventor uses a 9" diameter by a 9" length. The dual pillow system gives the flexibility to rest the toes on the front, or in between the two cushions while in the supine position which accommodates taller people.

Inventor suggests an 11" diameter by an 11" length cushion set for toe-tent usage for post podiatry surgery recovery. This dual pillow system also accommodates larger sized feet for supine position with the option to baby toe rest which is desirable to support the toes in the upright position to keep the feet from separating. With the larger 11 inch diameter cushions, inventor suggests the use of longer, California long flat sheets so as to not short the sheets in reaching the chin.

Figure 4:
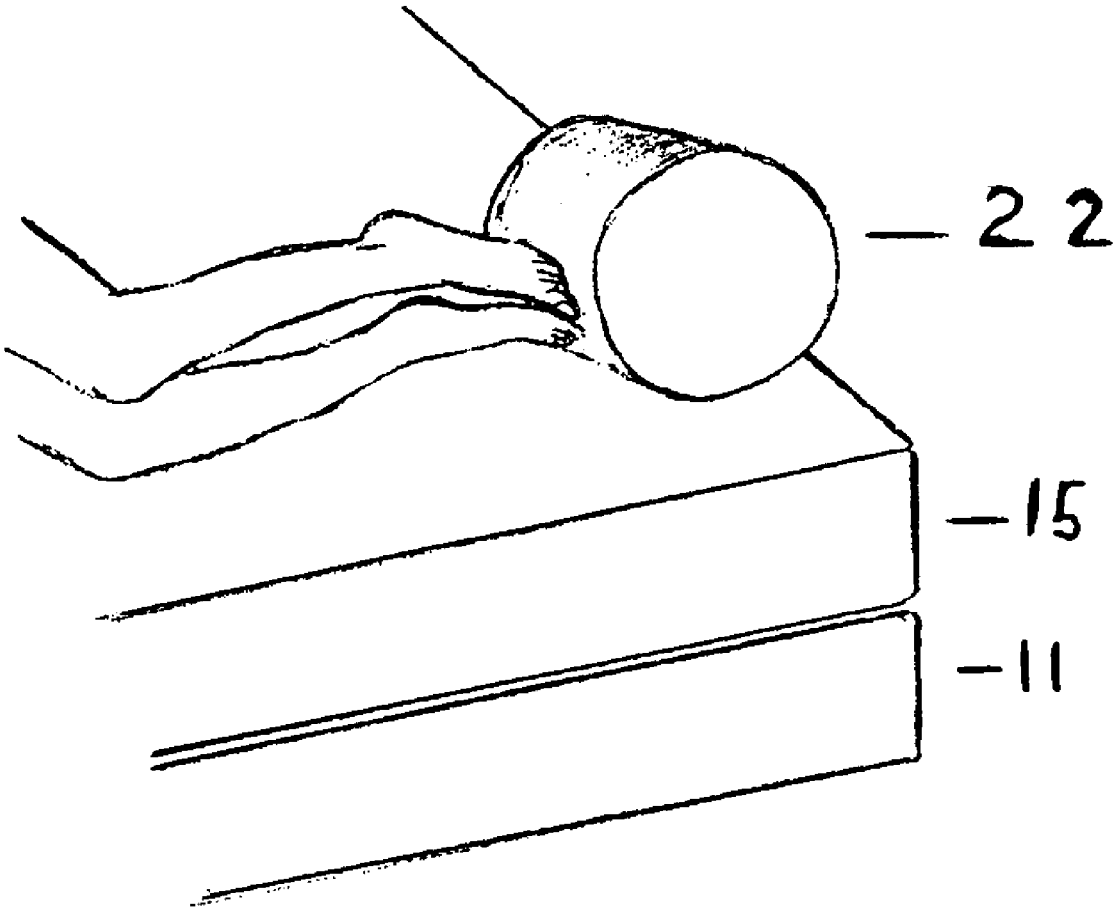
FIG. 4. is right side view of one short bolster.

Side sleepers, (as shown in FIG. 4 which is a right side view of one short bolster 22 with toes resting on the curved edge on a bed 11,15) will only need a one size fits all cushion. When side sleepers curl up, they do not generally have limitations on the length constraints of the bed. Inventor again suggests 9" diameter by 9" length cushion. However, extra large feet may want a diameter of larger than 9 inches. Also side sleepers need to move the cushion away from the edge of the bed up to meet their feet. This reduces the tension of the tucked sheets at the foot of the bed which keeps the pillow in place, so inventor suggests the use of a heavier viscosity foam like a memory foam so that it is more weighted.

Figure 5:
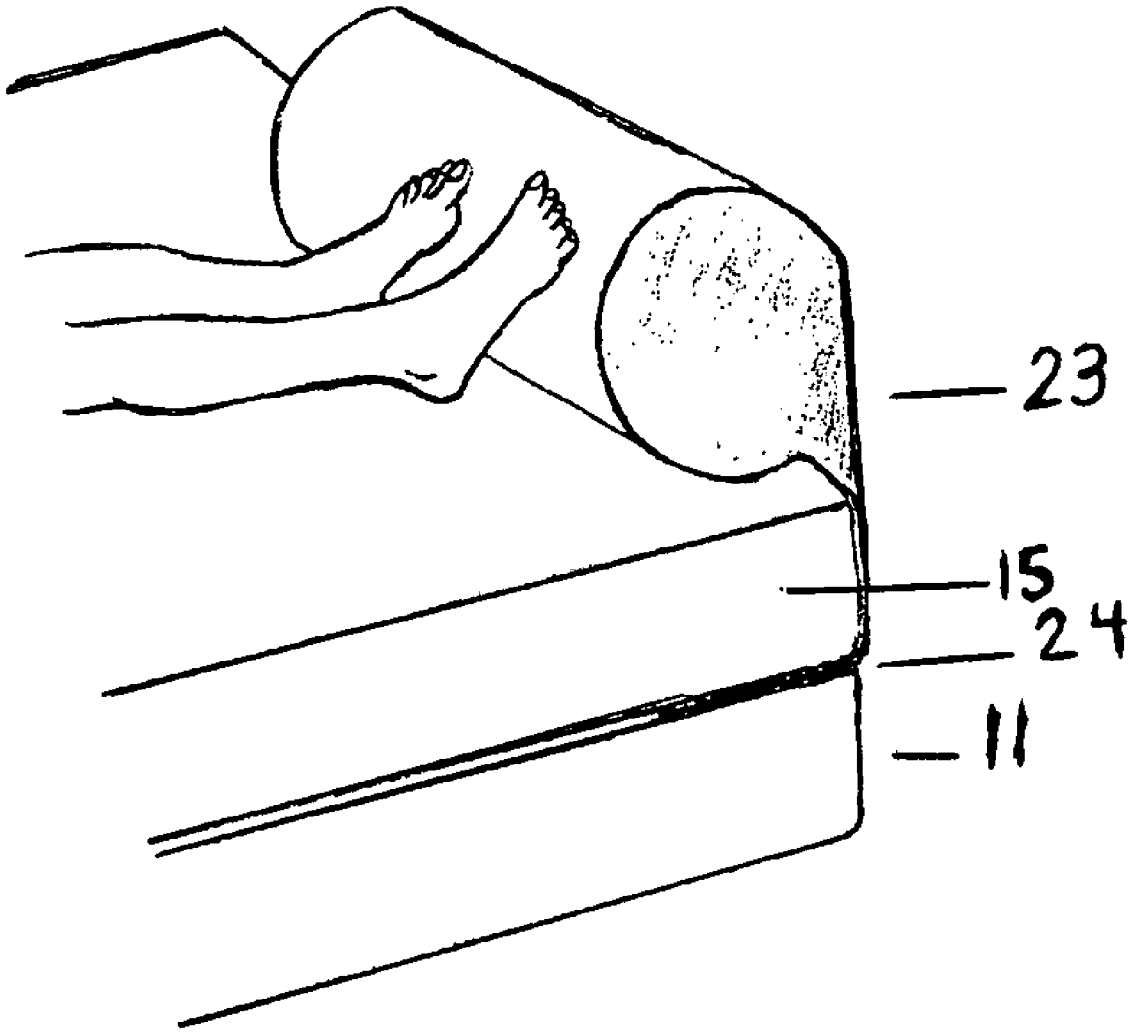
FIG. 5. is right side view of bolster secured by extended pillowcase flap tucked between mattress & box spring.

Another shaped frontal toe rest/blanket lift is sown in FIG. 5. which is a right side view of a quotation shaped bolster 23 that is secured by an extended pillowcase flap 24 that is tucked between the mattress 15 and the box spring 11 with toes resting on the curved edge while in the supine position. This shape (that can also be used in the dual pillow system) is unique for the purpose of saving diameter space at the foot of the bed, and further secures the cushion via a fitted pillow case with a long flap. The pillowcase flap 24 should be at least 24 inches. This variation of the quotation shaped cushion is not as easily removed from the bed as the fully round bolster.

Figure 6:
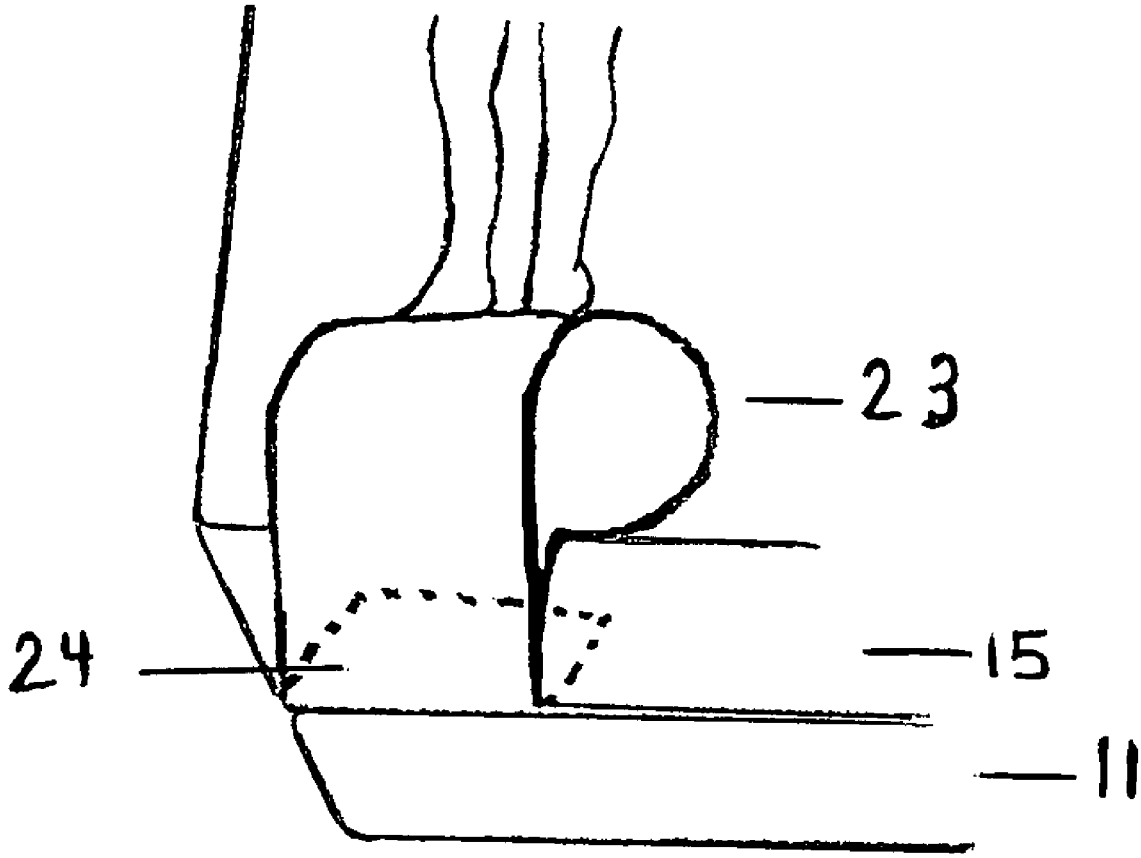
FIG. 6. is rear, aerial view of bolster secured by extended pillowcase flap tucked between mattress & box spring thereof.

FIG. 6. is a rear, aerial view of a quotation shaped bolster 23 as referenced in FIG. 5, is secured by an extended pillowcase flap 24 that is tucked between the mattress 15 and the box spring 11 with toes resting on the curved edge while in the supine position. Side sleepers can tuck a short bolster pillowcase flap further up on the side of the bed and resting their toes on the rounded edge if they sleep facing in towards the center of the bed.

Figure 7:
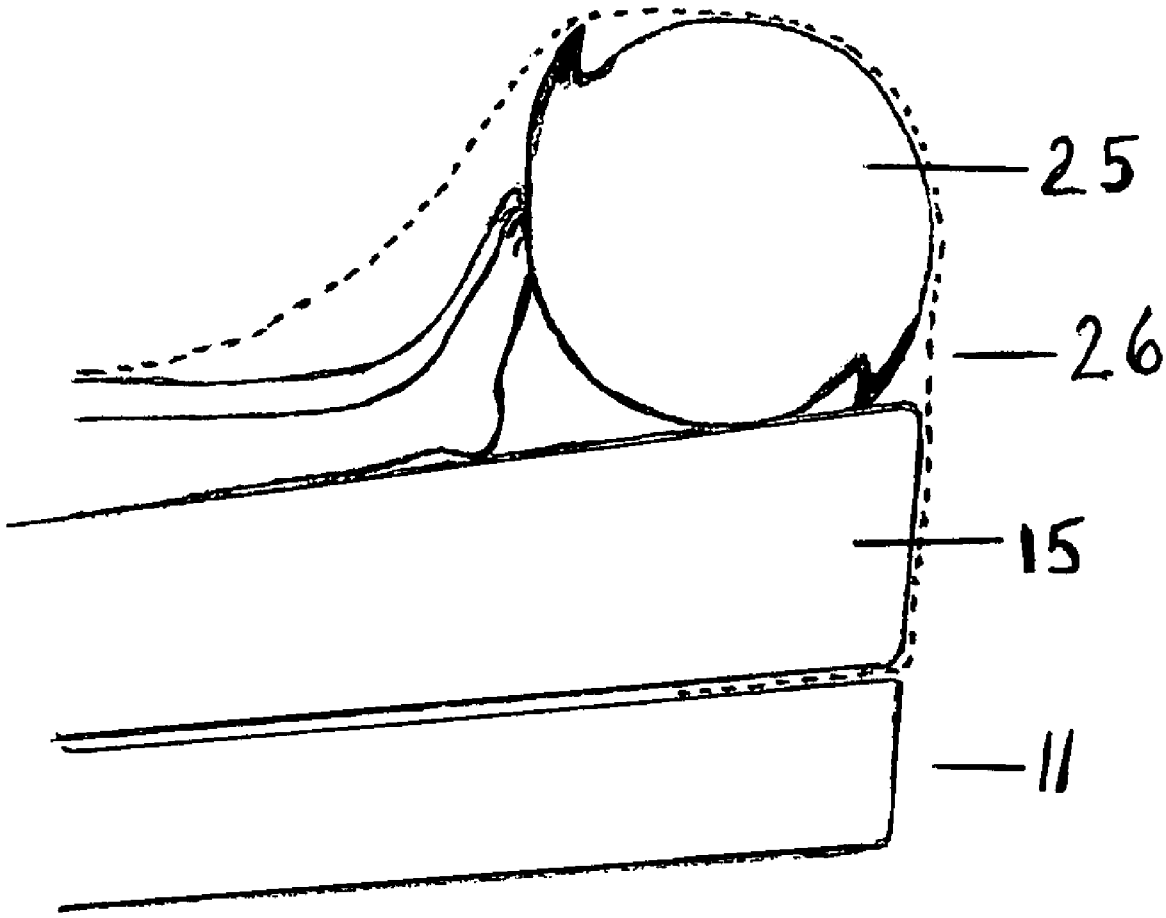
FIG. 7. is right side view of dotted lines representing tucked sheet lifted over apparatus.

FIG. 7. is a right side view of dotted lines representing the tucked flat sheet 26 as it is lifted over the toes resting on the curved edge of a cyclone shaped bolster 25 while in the supine position on a bed 11,15. The cyclone shaped bolster's tips or fins or flanges are facing clockwise and function to give an additional blanket lift to the flat sheet. Side sleepers and the dual pillow system can also be utilized with this variation of a cylindrical shape which is more costly to manufacture than the fully cylindrical bolsters. The tips extend past the diameters range for a ratio of an inch for every 9 inches. For example, inventor has a 9 inch cushion diameter with a 1 inch extension-tips, so then an 11 inch diameter would have corresponding 1.22 inch extension-tips. For the tips to be gripping, and for the foam to be resilient to the weight at the tips, the foam and the pillow case tips would need to be separately dipped, sprayed, or painted in durable, latex liquid. This application would be similar to the process used in texturing gloves such as gardening and outdoor use treated gloves which would make it more expensive to manufacture than the fully round bolsters and should be obvious to those skilled in the art of glove texturing.

Figure 8:
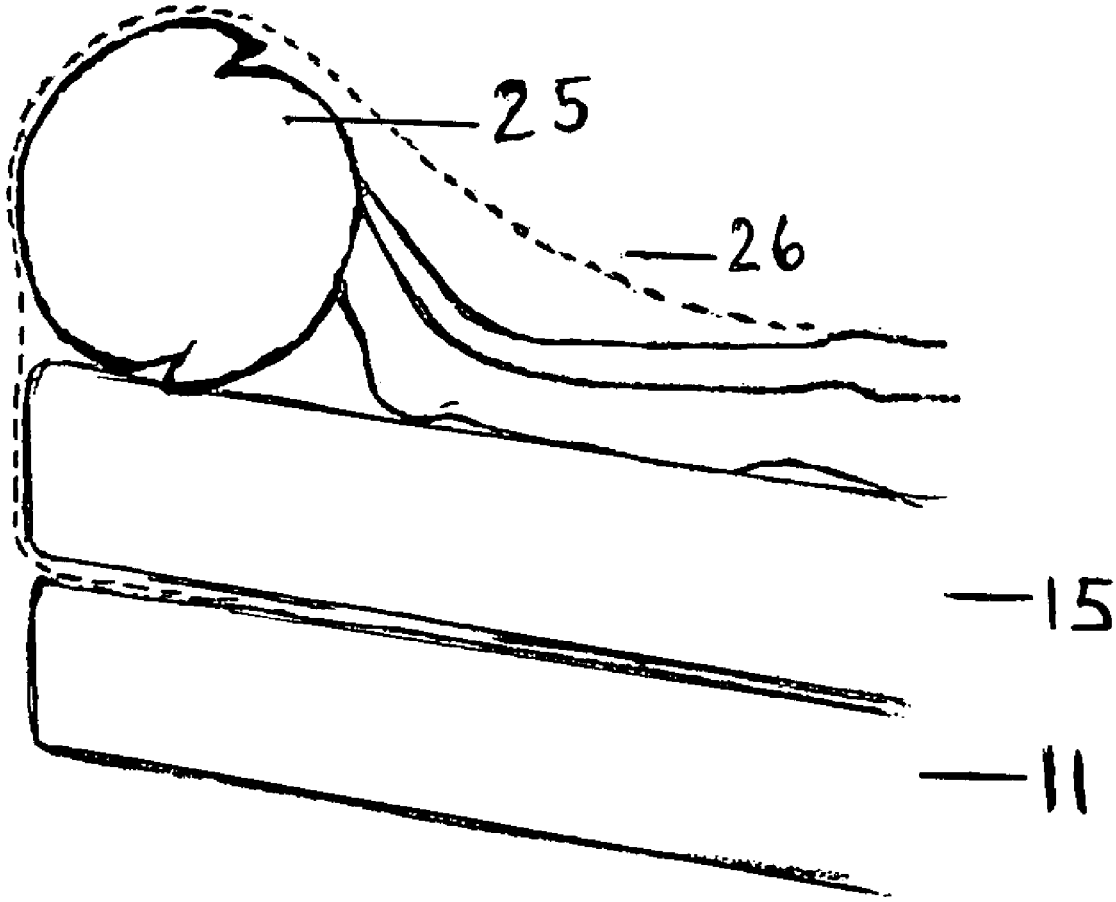
FIG. 8. is left side view of dotted lines representing tucked sheet lifted over apparatus.
Figure 9:
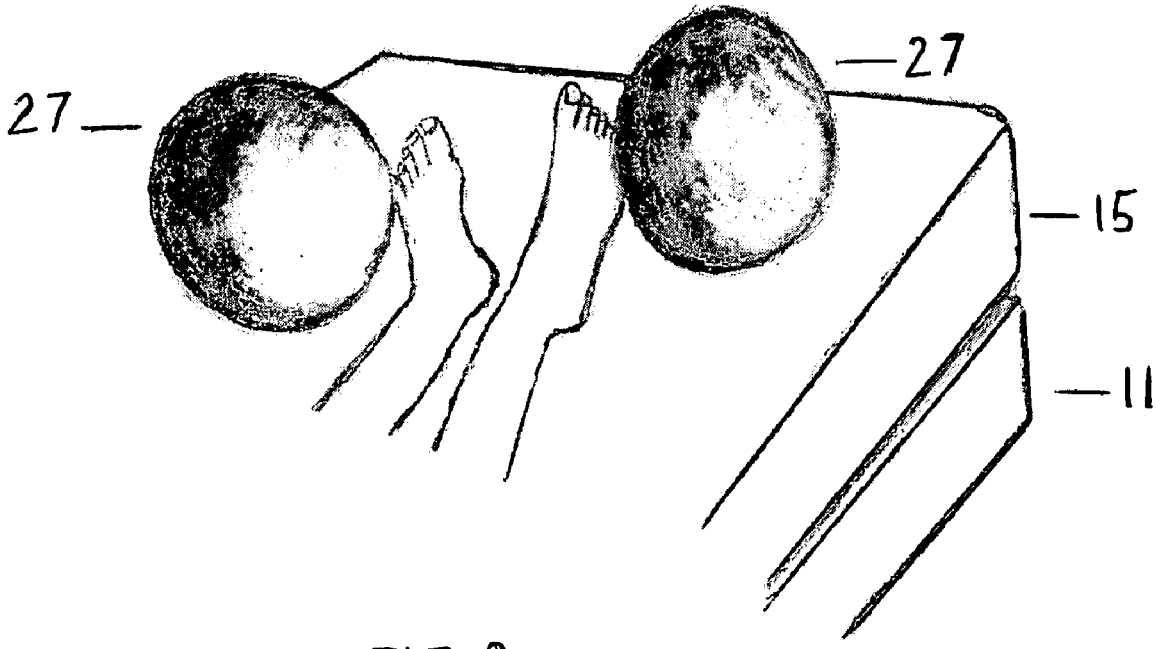
FIG. 9. is right, aerial view of two round bolsters.

FIG. 8. is a left side view of dotted lines representing the tucked sheet 26 as it is lifted over the toes resting on the curved edge of a cyclone shaped bolster 25 while in the supine position on a bed 11,15. The cyclone shaped bolster's tips are facing clockwise and is detailed in FIG. 7 thereof.

The dual pillow system method accommodates taller people by placing the feet between the cushions, and gives the option to baby toe rest on the curved edge while in the supine position.

Toe tent usage for post podiatry surgery recovery is evident in the dual pillow system. Inventor suggests an 11" diameter for medical or sports podiatric recovery and also larger, healthy feet who have the option to baby toe rest in the supine position. It is desirable to have support for the toes to remain in the upright position, yet have the flexibility to side sleep. With the larger diameter cushions, inventor suggests the use of longer California long flat sheets.

Figure 10:
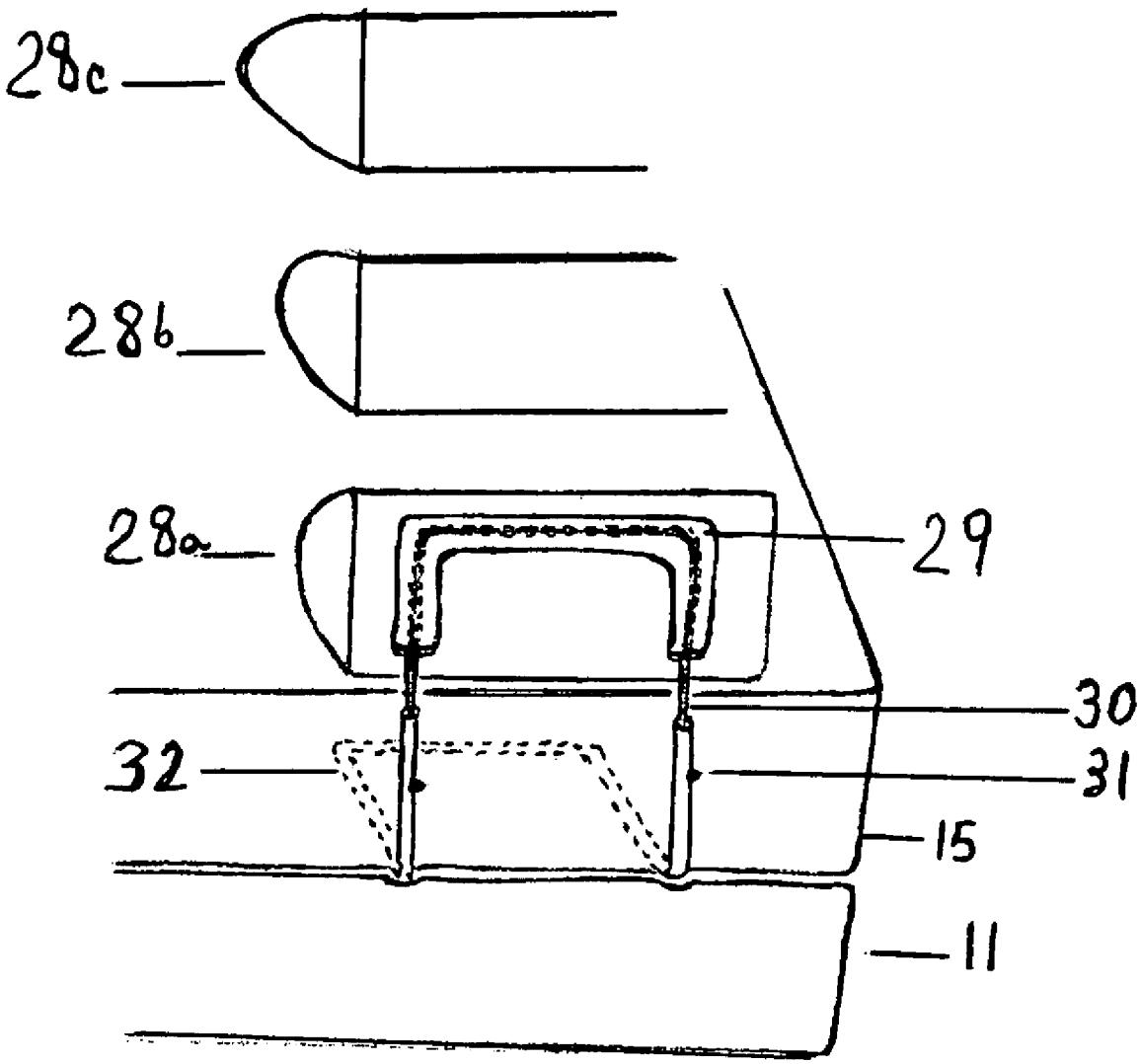
FIG. 10. is rear, aerial view of three bolsters-one is shown fastened to adjustable frame secured between mattress & box spring.

FIG. 10. is the inventor's installed version of a toe-rest, and is thus an improvement to prior art blanket lift frames that do not have a cushion. Inventor suggests a 9" tall by 18" long partially round bolster to be attached to a frame for taller people in the supine position which takes up half the space than that of a fully round bolster at the foot of the bed.

FIG. 10. shows a rear, view of three different curved slope sizes for partially round bolsters 28*a*, 28*b*, 28*c*, of which one 28*a* is shown fastened via the pillowcase sleeve 29 to the adjustable, blanket lift frame 30, 31, & 32 that is secured between mattress 15 and box spring 11. The sleeve to receive stabilizing bar is centered on the pillowcase and is shaped as an upside down block style U.

Inventor suggests for a partially round bolster, that the stabilizing frame be half as long (9"). The frame should be in two pieces. One which is the 90 degree piece whose base 32 should be 12" deep and 12" tall. The second piece is the removable, adjustable rod 30 that fits in the 90 degree shaped frame 32. The removable, adjustable rod 30 should be 9 to 15 inches tall for a total vertical height range to be adjustable from 21" to 27".

Stabilizing the partially round pillow in a vertical position is achieved by threading the removable portion of rod 30 through the pillowcase sleeve 29 or by utilizing tie fasteners. Next add pillow to pillowcase, and then position removable rod 30 back into its frame 32, and then place frame's base 32 between the box spring 11 and the mattress 15. The weight of the mattress keeps the frame in place at the foot of the bed (or the side of the bed for side sleepers that face in to the center of the bed). Lastly, the flat sheet and blankets are tucked under the frame 32 and draped over the bolster with frame creating the toe rest/blanket lift.

The adjustable height rod mechanism pictured in drawing has a spring loaded push button catch 31 as described in U.S. Pat. No. 5,542,150. The stabilizing frame is similar to blanket lift in U.S. Pat. No. 6,834,403. Aluminum frame's curved tops and curved bottoms are bent into shape with a pipe bending machine using preferably small, tubular diameters of metal.

The upper frame that the pillowcase attaches to has a 0.25" OD. The base of the frame should be a slightly larger diameter such as a 0.305" ID to receive the smaller rod, however, larger diameters may be needed to allow for the internal spring catch mechanism which should be obvious to those skilled in the art of metal fabricating and frame assembly.

The adjustable frame's pillow case has a sleeve 29 to receive the rod 30. The sleeve is shaped as an upside down block shaped u that is 2 inches wide. The top and bottom margin from the pillow case seem to the sleeve is ½" and the left and right margin from the pillowcase seem to the sleeve is 2".

Also, the same frame in FIG. 10 can be more affordably manufactured without the vertical height adjusting mechanism or the need for a pillow case sleeve. The economy version frame is also bent into shape and is also in two pieces to be assembled, but on the economy model, the frame base 12" or less depth is connected to the longer, 27" upper frame by two 90 degree elbows.

Figure 11:
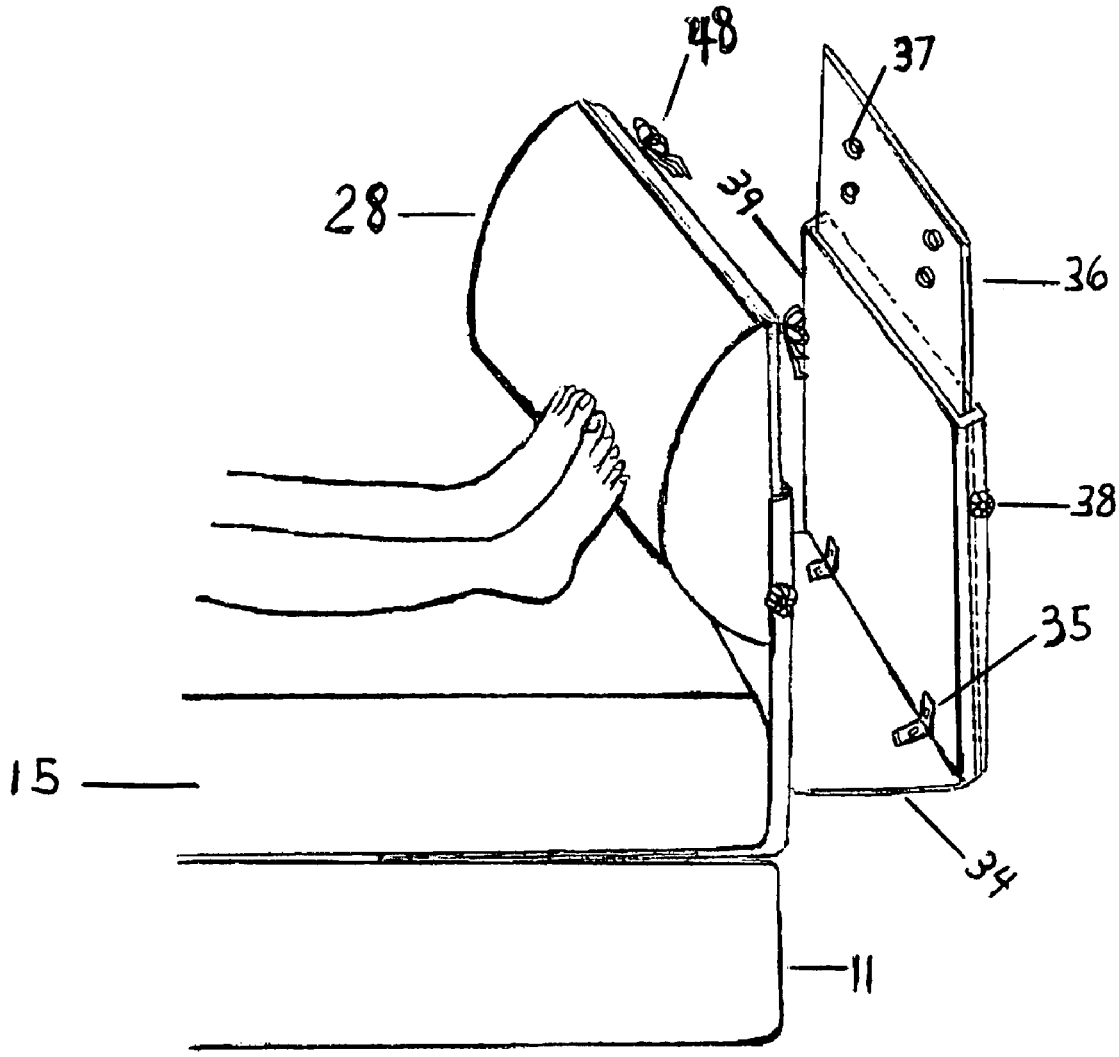
FIG. 11. is right, side view of partially round bolster fastened by ties to adjustable frame secured between mattress & box spring.
Figure 13:
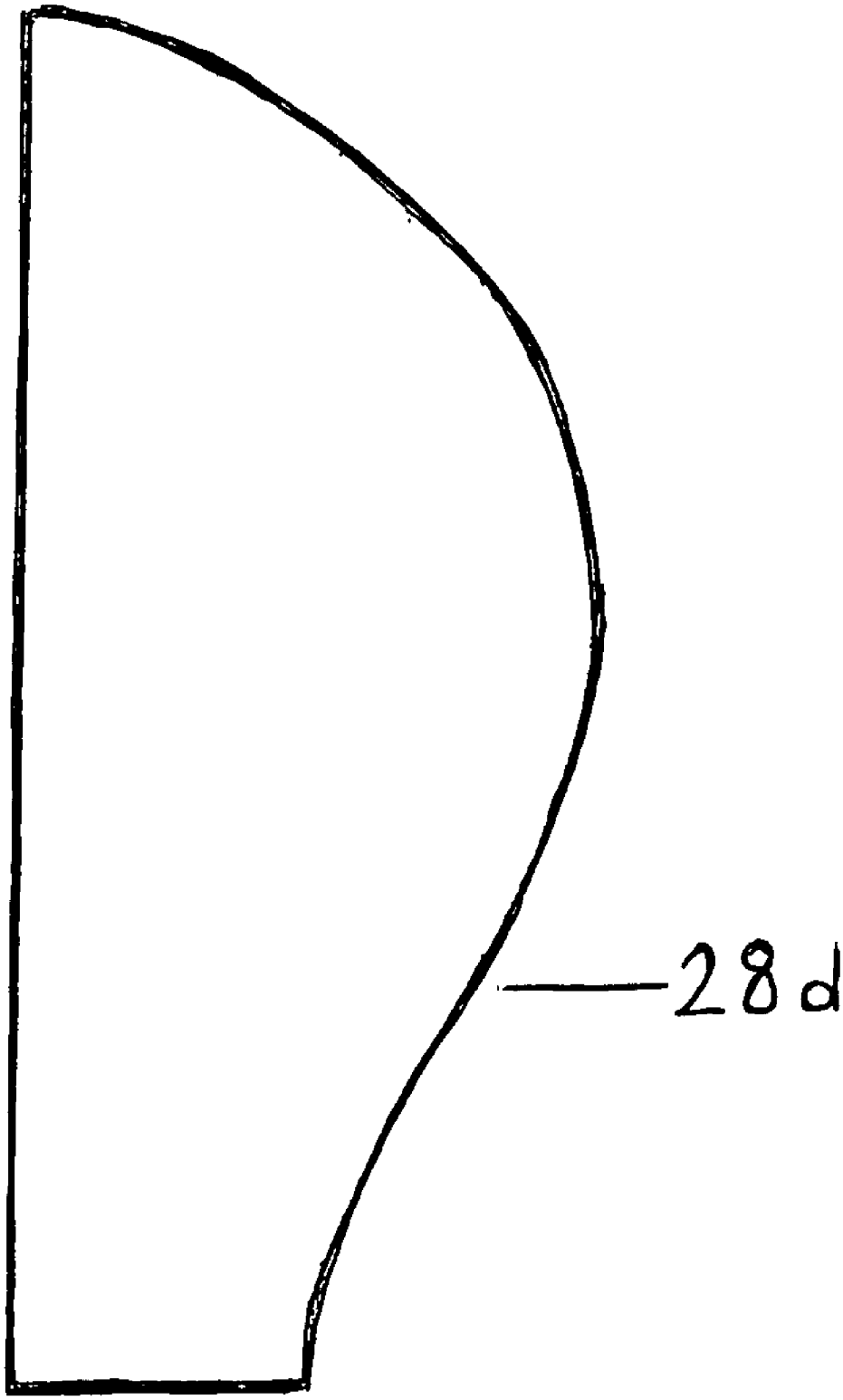
FIG. 13. is side view of partially round bolster with flat base that sits flush on bed.

Cushion 28*a*, or 28*b*, or 28*c*, or cushion shown in FIG. 13. 28*d*, is tied to the frame by ties as shown in 48 FIG. 11. The ties for a 9" high by 18" long pillow can be sewn onto pillow case at 4.5" from left and right margin with a ½" top margin and or bottom margin if having two sets of ties per pillow.

FIG. 11. is another installed and adjustable in height version of novel toe-rest. The drawing in FIG. 11 shows the frame to be the same length 18" as the (9" high×18" long) pillow that it supports, however, the frame can be cut down in length up to half the length of the pillow (9") to save on materials.

Stabilizing the partially round cushion 28 in a vertical position is achieved by the pillowcase having a means (such as ties) to be fastened 48 to a ninety degree angle frame 34, 36, 39. The base 34 can be up to 12 inches deep and is slipped between the box spring 11 and mattress 15, at the foot of the bed and is held in place by the weight of the top mattress. Pillow case ties 48 should align with holes on the frames.

Side sleepers can slip the bottom 34 between the box spring 11 and mattress 15, up higher on the side of the bed to rest their toes on the curved edge if they sleep facing in to the center of the bed thereby controlling the length needed to toe-rest when in the curled position.

Shown in FIG. 11, is optional butler, foldable hinge 35 that connects the base (12" or less deep) to its top (which can be adjustable up to 27 inches high), and is for folding down the frame for shipping and storage.

The optional adjustable height mechanism 38 functions like a sash holder (patent #51918, Calderwood), and screws into the top portion (21" high) of the frame 39 which houses and secures the inner, adjustable height sliding board 36 (8" tall).

The optional, inner, sliding board 36 has holes 37 as a means to fasten the pillow case ties 48 to the blanket lift frame. Depending on the length of the frame (between 9 to 18 inches), the holes should be cut in the frames, to align with the pillowcase ties.

If choosing to manufacture an economy version of FIG. 11, eliminate the vertical, inner board adjusting height mechanism, and cut holes 37 for ties on main board 39 (up to 27 inches tall). The hinge is also optional when the metal or plastic is manufactured (metal fabricated or molded plastic respectively) as one piece.

Acute or obtuse angles can also be manufactured into frames to be horizontally adjustable for shorter or taller people (respectively) by using a bending machine for metal such as aluminum with the necessary holes 37 made in the upper portion to receive the tie fasteners 48.

Molds for plastic one piece units can also be manufactured at acute or obtuse angles to accommodate varying heights of people wanting the installed version of toe-rest/blanket lift.

Figure 12:
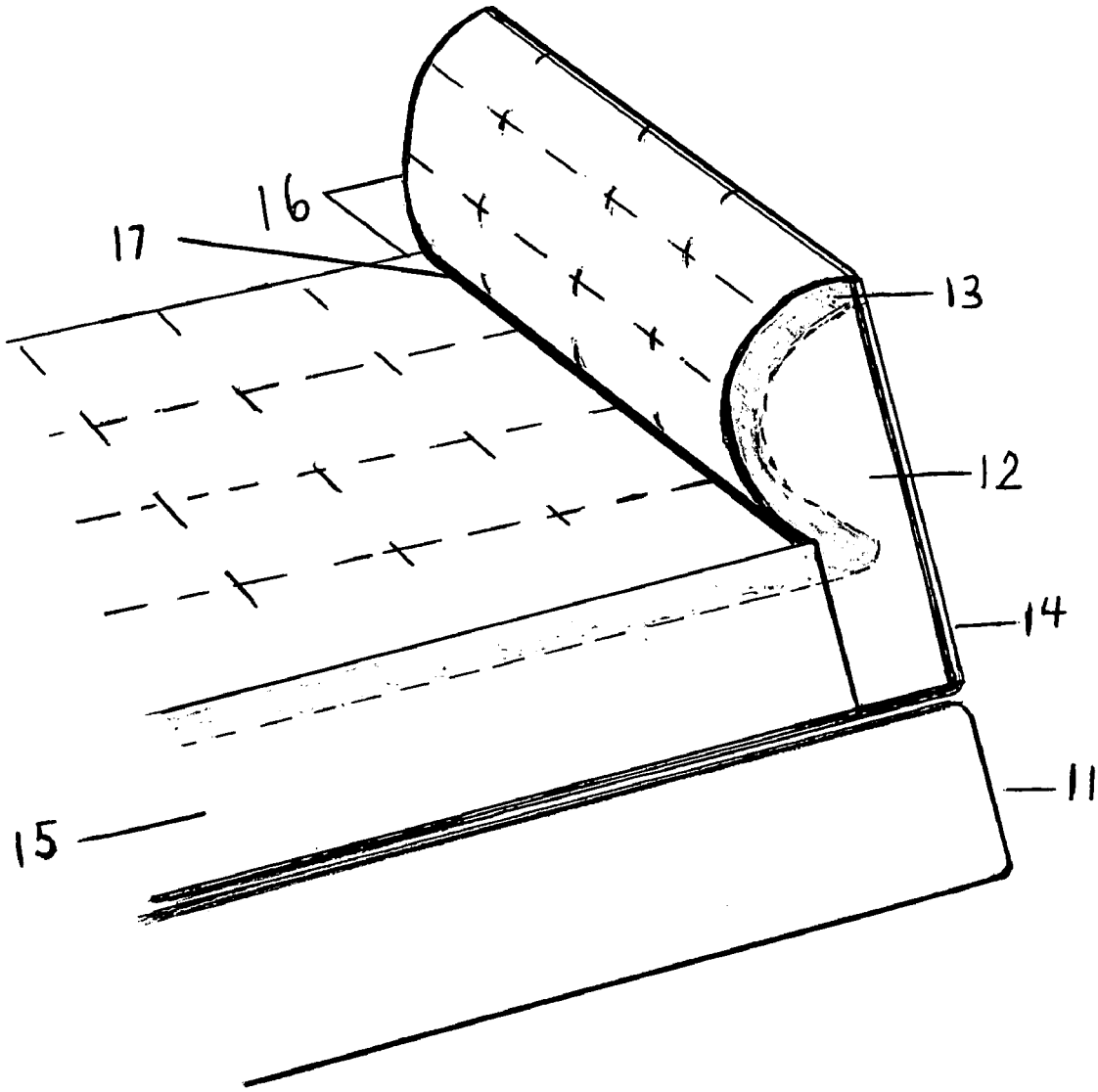
FIG. 12. is right side view of manufactured mattress with top layer formed into protrusion and secured to stabilizing board.

FIG. 12 will be detailed following FIG. 13. FIG. 13. is a side view of a partially round bolster 28*d* and sloping to meet a flat base that attaches to the economy stabilizing frame/board. The cushion's short flat edge sits flush on the bed with the curved edge facing the feet, and the long flat edge attaches to the economy (not adjustable in height) frame or board.

The pillowcase fasten ties is shown in FIG. 11, 48. The ties for a 9" high by 18" long partially round pillow can be sewn onto pillow case at 4.5" from left and right margin with a ½" top margin and or bottom margin if having two sets of ties per pillow.

Inventor's permanent toe rest/blanket lift is shown in FIG. 12, and is a right side view of a manufactured mattress 16 with a top layer of memory foam. Adding length to the beds 11, 15 during manufacture accommodates tall people, however, would also warrant specialty fitted sheets for the protrusion. The length added to the mattress (keeping traditional bed widths) replaces the length space used up at the foot of the bed by the partially round shaped protrusion.

For coil, inner spring mattresses and foam mattresses, the top layers of block foam and memory foam 13 are lengthened so that the excess can be formed into a partially round protrusion for the purpose of a toe rest/blanket lift.

A traditionally sized queen/king bed is 80 inches in length. The extra length needed to form a 10 inch tall, half bolster is 15.7 inches. The half bolster will take up an additional 5 inches at the foot of the bed which brings our excess topper length needed (prior to being framed) at 15.7+5=20.7 This increases the length of the topper of the mattress from 80 inches to 100.7 inches. The length of a half circle formula is pi times diameter divided by two (3.1416×10 diameter)/2. The framed coil or foam mattress would only increase from 80" to 85". The excess topper is formed into a circle by flipping the excess back towards the head of the bed, or by pushing the excess forward and making a kink and then sewing or gluing it in place and should be obvious to those skilled in the art of custom mattress fabrication.

Next, form the circle into a partially round circle and add stability to the protrusion, by adhering a plastic or wooden footboard 14 (whose height is 10 inches plus the mattress thickness) to the back end of the bolster to force the circle into a partially round shape 10 inches high. The board may be ninety degrees for added stability at the base. Foam may be needed around the outside of the wood/plastic prior to framing to reduce the stress and friction of the hard materials rubbing on the fabric that frames the mattress with protrusion.

Next, frame the mattress and bolster by sewing the outer encasing fabric. Lastly, sew a heavy stitching seem 17 to reinforce the base where the curved edge begins.

Another permanent method of manufacturing a bolster to a coil or foam mattress as shown in FIG. 12 is to separately form a topper piece that is 15.7 inches long plus the mattress thickness (keeping traditional bed widths), into a P shape 12, add a stabilizing board as described above, and have it sewn, or glued, or bolted on to the unframed mattress 15.

The coil or foam mattress should be 85 inches in length. Then frame the mattress and bolster by sewing the outer encasing fabric. Lastly, sew a heavy stitching seem 17 to reinforce the base where the curved edge begins.

Although this invention has been conveyed in terms of the foregoing embodiments, such descriptions are for illustration purposes only and, will be apparent to those of ordinary skill in the art. Invention is not to be limited in any respect by the foregoing description, rather, it is defined only by the claims which follow for any partially round bed protrusion for toe-rest/blanket lift.

The embodiments of the invention in which exclusive rights inventor claims is defined as follows:

1. A toe-rest bed and blanket lift manufactured into a mattress or mattress and box spring at a foot end thereof and comprising of;

a protrusion, having at least one curved edge and two generally flat opposing ends, wherein the box spring is longer in length than the mattress in order to compensate for the depth of the protrusion, and comprising of;

a mattress topper being even longer than the mattress and the box spring, wherein the excess topper length is crimped or bunched to form the at least one curved edge of the protrusion and faces toward the toes of a user resting in a supine position on the mattress in order to provide a comfortable resting surface.

* * * * *